United States Patent [19]

Allen et al.

[11] 4,350,401

[45] Sep. 21, 1982

[54] DETACHABLE ELECTRICAL CONNECTOR ASSEMBLY HAVING IMPROVED MEANS FOR ALIGNING CONNECTOR PARTS

[75] Inventors: Ralph A. Allen, Covina; John T. Zylkowski, Diamond Bar, both of Calif.

[73] Assignee: Kortech Engineering, Inc., Fullerton, Calif.

[21] Appl. No.: 120,069

[22] Filed: Feb. 11, 1980

[51] Int. Cl.[3] ..... H01R 13/62

[52] U.S. Cl. ..... 339/65

[58] Field of Search ..... 339/65, 66, 94 A, 184

[56] References Cited

U.S. PATENT DOCUMENTS

| | | | |
|---|---|---|---|
| 3,259,872 | 7/1966 | Kyle | 339/94 A |
| 3,371,147 | 2/1968 | Danbenberger et al. | 339/94 A |
| 3,390,705 | 1/1976 | Gallagher | 339/66 M |
| 3,848,953 | 11/1974 | Petroshanoff | 339/65 |
| 4,162,816 | 7/1979 | Malsot | 339/66 M |

OTHER PUBLICATIONS

IBM Technical Disclosure Bulletin, vol. 3, No. 6, 11-1960, pp. 2 & 3.

*Primary Examiner*—Joseph H. McGlynn
*Attorney, Agent, or Firm*—Fischer, Tachner & Strauss

[57] ABSTRACT

A rugged and durable, detachable electrical connector assembly is disclosed comprising removable engaging and stationary receiving complementary connector parts. Each connector part includes a housing, a terminal block, and a respective plurality of either electrical pin or socket contact members. The respective pin and socket contact members are electrically interconnectable in a mating relationship with one another by inserting the engaging connector part within the housing of the receiving connector part. The housing of the receiving connector part is provided with a unique configuration to enable the engaging connector part to be accurately aligned in each of three orthogonal directions therewith, so that the engaging connector part can be guided into a detachable connection with the receiving connector part. The presently disclosed electrical connector assembly has particular utility for enabling an efficient and reliable interconnection of the connector parts by means of remote control from a distant work area.

2 Claims, 5 Drawing Figures

Fig. 3
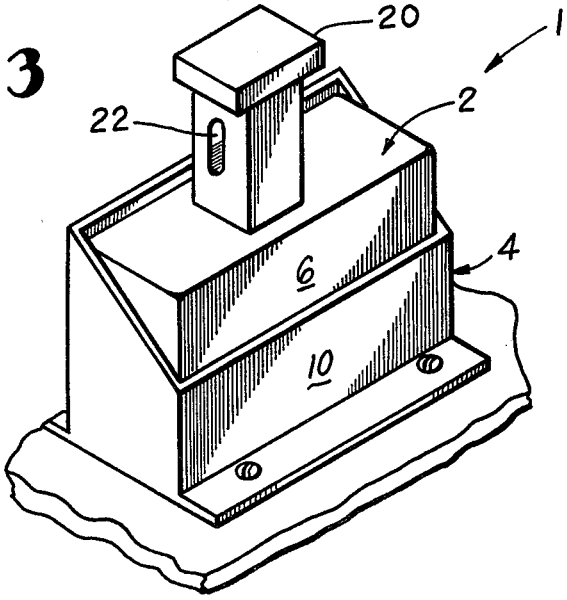
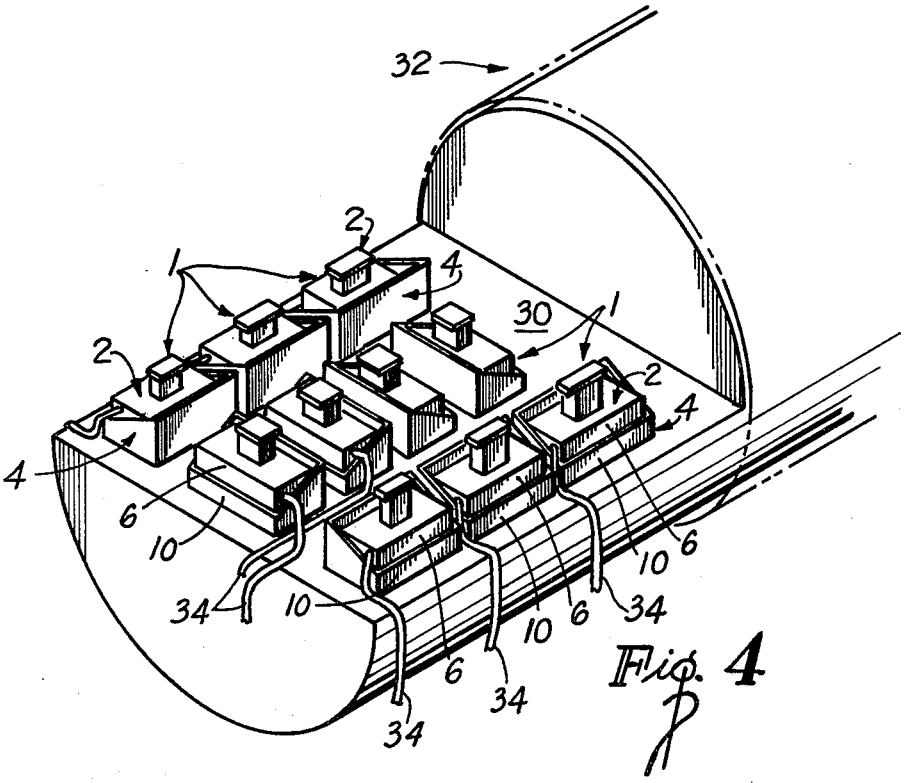
Fig. 4

DETACHABLE ELECTRICAL CONNECTOR ASSEMBLY HAVING IMPROVED MEANS FOR ALIGNING CONNECTOR PARTS

BACKGROUND OF THE INVENTION

1. Field of the Invention

This invention relates to an improved detachable electrical connector assembly comprising complementary connector parts that are particularly structured, so that the parts can be accurately aligned with one another for reliably inserting and interlocking a removable engaging connector part within the housing of a stationary receiving connector part. The presently disclosed connector assembly has particular application in a hazardous environment, wherein the engaging connector part can be detachably connected to the receiving connector part by means of remote control from a distal command station.

2. Statment of the Prior Art

There exists a need to be able to efficiently and reliably connect a run of electrical wiring to various instrumentation or electrical apparatus that are located within certain environments that are hostile to human life. Such hostile environments may be characterized by either extremely high or low temperature, noxious gas or chemicals, hazardous radioactivity, etc. So as to protect a technician from injury due to the environment, it is desirable to control the interconnection of the respective electrical connector members associated with the apparatus and the wiring run from a remotely located work area that is safe for human occupation. Available devices by which to either control the aforementioned interconnection or to remove a run of wire and its corresponding connector from the hostile environment for re-wiring, repair, or replacement may include either of a conventional master-slave or electromechanical manipulator, which devices may be remotely controlled at a distant work area.

However, when reconnecting the respective connectors associated with the electrical wiring and the stationary electrical apparatus, a remotely stationed technician having limited visual access typically experiences great difficulty and consumption of time in attempting to properly align the removable connector for interconnection in a mating relationship with its complementary connector located in the hostile environment.

There are detachable electrical connector assemblies known to those skilled in the art that are comprised of portions, which connector portions are adapted to be mated and interlocked with one another for interconnecting different runs of electrical wires. Examples of conventional electrical connector assemblies that include two complementary connector portions for mating one portion within another can be found in the following U.S. patents:

| U.S. Pat. No. | Date of Issue |
|---|---|
| 2,730,687 | January 10, 1956 |
| 2,987,693 | June 6, 1961 |
| 3,035,243 | May 15, 1962 |
| 3,075,165 | January 22, 1963 |
| 3,146,051 | August 25, 1964 |
| 3,157,449 | November 17, 1964 |
| 3,409,858 | November 5,1968 |
| 3,594,696 | July 20, 1971 |
| 3,701,083 | October 24, 1972 |

-continued

| U.S. Pat. No. | Date of Issue |
|---|---|
| 3,786,391 | January 15, 1974 |

However, while some of the above-identified patents show electrical connector assemblies that include respective means (e.g. slots, pins, and clips) for guiding one connector portion into a mating relationship with another, none of said patents discloses a connector assembly that provides accurate alignment of the connector portions in each of three (e.g. orthogonal) directions. Accordingly, none of the connector assemblies shown in the above-identified patents is suitably structured to facilitate a reliable and efficient, detachable connection of two complementary connector portions under the control of an operator who is located at a remote work area.

SUMMARY OF THE INVENTION

Briefly, and in general terms, a rugged, detachable electrical connector assembly is disclosed having a particular configuration for interconnecting complementary connector parts by means of a remotely controlled apparatus. The preferred connector assembly comprises a detachable upper engaging connector part and a stationary lower receiving connector part. Each connector part includes a generally rectangular housing and a terminal block having a respective plurality of either electrical pin or socket contact members that are adapted to be mated to one another. The lower receiving connector part is uniquely shaped, such that the top of the housing thereof is cut away at an angle to define an inclined plane, and particularly sized, in order to receive therein a portion of the upper engaging connector part in a mating relationship therewith. By virtue of the particular configurations of the connector parts relative to one another, the instant connector assembly is provided with a shape that facilitates an accurate alignment of the upper engaging connector part in each of three generally orthogonal directions with the lower receiving connector part, so that the upper connector part can be reliably inserted through the top of and into electrical connection with the lower connector part. The engaging connector part is provided with a handling bar, whereby an operator, at a remote location, can control the alignment and detachable connection of the engaging connector part to the receiving connector part with relative ease and efficiency.

BRIEF DESCRIPTION OF THE DRAWINGS

FIG. 3 shows the complementary connector parts of FIGS. 1 and 2 electrically connected to one another in the assembled relationship.

FIG. 4 shows a plurality of the electrical connector assemblies of the present invention positioned on a platform that is located in an environment that may be hazardous to human life.

DESCRIPTION OF THE PREFERRED EMBODIMENT

Figure 1:
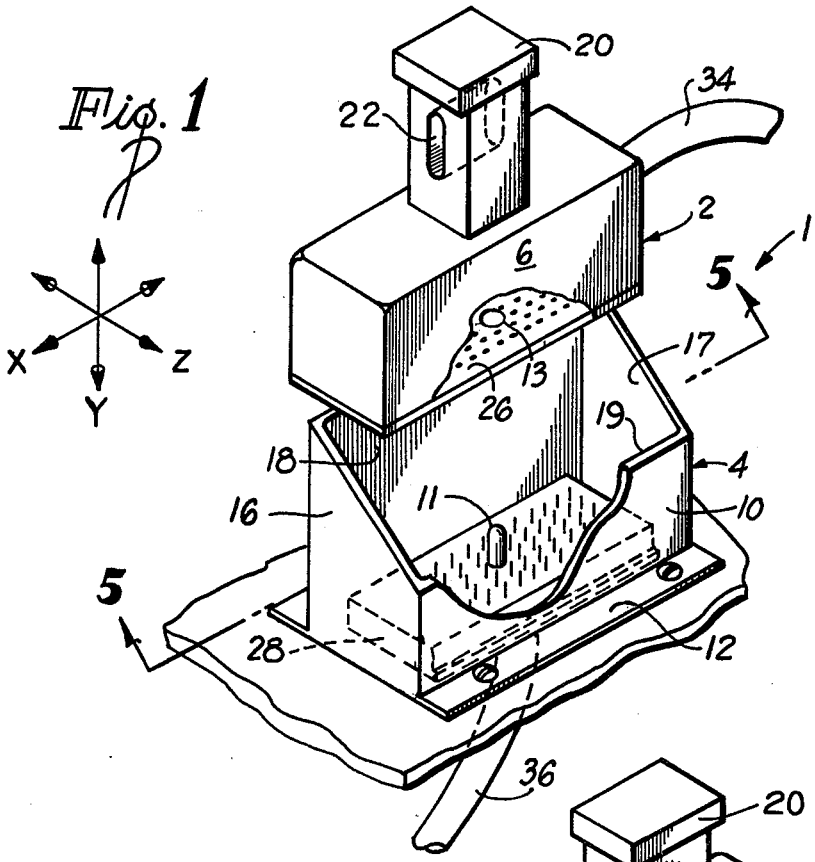
FIG. 1 illustrates the complementary connector parts which form the electrical connector assembly of the present invention, said complementary connector parts being detached and vertically displaced from one another.
Figure 2:
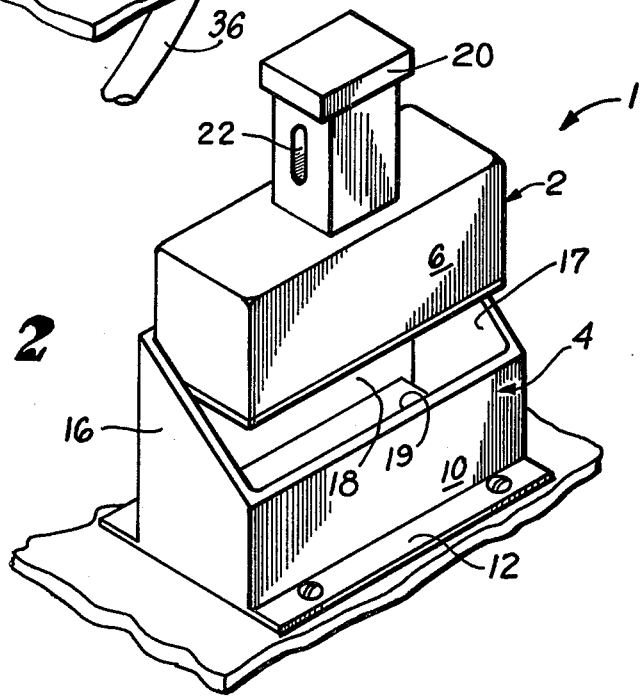
FIG. 2 shows a complementary connector part accurately aligned with and being reliably guided into a detachable electrical connection with its complementary connector part, which connection can be effected by means of remote control.

Referring concurrently to FIGS. 1, 2, and 3 of the drawings, the rugged and durable, detachable electrical connector assembly 1 of the present invention is shown with the complementary connector parts thereof detached and vertically displaced from one another. The connector assembly 1 comprises a detachable upper plug or engaging connector part 2 and a stationary lower receptacle or receiving connector part 4. The engaging connector part 2 includes a rectangular housing 6 that encloses a respective terminal block 26. Terminal block 26 is attached to an inner surface of connector part 2. The receiving connector part 4 also includes a substantially rectangular housing 10 that comprises a flat bottom face 12 which may have associated flange members to permit the lower connector part 4 to be secured to a desirable surface. A terminal block 28 is attached to an inner surface of connector part 4, so as to be surrounded by housing 10. Housings 6 and 10 are preferably fabricated from a non-corrosive, temperature resistant material, such as a suitable dielectric.

The particular contact arrangement of terminal blocks 26 and 28 and their interconnections with respective runs of electrical wiring is best illustrated in FIG. 1. More particularly, terminal blocks 26 and 28 are conventional in structure, being formed from a suitable non-conductive material such as molded plastic, or the like. One of the terminal blocks 28 includes a convenient plurality (e.g. 104) of pin contact members, while the other of the terminal blocks 26 includes a corresponding plurality of socket contact members. It is to be understood, however, that the upper connector part 2 could be the receptacle and include either of the pin or socket contact members, and the lower connector part 4 could be the plug and include the complementary plurality of contact members. The pin and socket contact members are mated with one another when the engaging and receiving connector parts 2 and 4 are electrically connected together in the assembled relationship. A guide pin 11 of conventional design may be formed on the terminal block 28 associated with one of the connected parts 4 and adapted to fit within a corresponding guide hole 13 formed within the terminal block 26 associated with the other connector part 2. Guide pin 11 and guide hole 13 properly align the pin and socket contact members with one another when connector parts 2 and 4 are connected together. Each terminal block 26 and 28 has a cable 34 and 36 associated therewith. Each of cables 34 and 36 carries a plurality of runs of electrical wire that terminate at the contact members of terminal blocks 26 and 28, respectively. A purpose for the electrical wires carried by cables 34 and 36 is more fully described when referring to FIG. 4 of the drawings.

In accordance with a preferred embodiment of the present invention, each of the upper engaging and lower receiving connector parts 2 and 4 are particularly structured relative to one another, so as to provide a reliable and efficient alignment and guide means for connecting the upper engaging connector part 2 to the lower receiving connector part 4. More particularly, the housing 10 of the receiving connector part 4 is uniquely shaped, such that the top thereof is cut away at an angle that extends downwardly from back to front. The angled housing 10 defines an inclined plane and creates an opening to expose the terminal block 28 thereof to the housing 6 of connector part 2. The housing 10 of receiving connector part 4 is sized relative to the housing 6 of engaging connector part 2, so that, when properly aligned with one another, a portion of the engaging connector part 2 can be guided into a detachable electrical connection with the receiving part 4 through the open top of housing 10.

Accordingly, the sidewalls 16 and 17 of the housing 10 of receiving connector part 4 form parallel planes for maintaining the inserted engaging connector part 2 in a proper alignment within the housing 10, whereby to minimize any side-to-side movement (in a direction indicated by the arrows designated X) of connector part 2 that may be caused by shock or vibration. Inasmuch as the top of housing 10 is downwardly angled, as previously disclosed, the back wall 18 of housing 10 forms an extended plane which is taller than its opposite front wall 19. Back wall 18 is structured to guide connector part 2 into engagement with receiving connector part 4 when connector part 2 is moved vertically (or in a direction indicated by the arrows designated Y) towards connector part 4 from a position thereabove. What is more, the extended plane provided by the back wall 18 of housing 10 adds an additional dimension for achieving suitable alignment of upper connector part 2 relative to lower connector part 4, so that connector part 2 can be moved horizontally (or in a direction indicated by the arrows designated Z) and above the front wall 19 of housing 10 until contact is made with the back wall 18. Thus, by virtue of the particular configurations of lower receiving connector part 4 and upper engaging connector part 2, the housing 6 of detachable connector part 2 can be accurately aligned with the housing 10 of stationary connector part 4 in each of three, generally orthogonal directions (as represented by the directions of the arrows designated X, Y, and Z), so as to facilitate the reliable guidance of connector part 2 through the open top of housing 10 and into a mechanical and detachable electrical connection with connector part 4. An advantage of the accurate, three dimensional alignment, as just disclosed, in an electrical connector assembly will be described, hereinafter.

The top end of housing 6 of engaging connector part 2 may be provided with a suitable means to enable the positioning or removal of engaging connector part 2 relative to stationary receiving connector part 4. By way of particular example, engaging connector part 2 includes a handling bar 20 attached thereto. The handling bar 20 includes a suitable slot or opening 22 by which to grasp handling bar 20 in order to facilitate the handling of connector part 2 for achieving the proper alignment and detachable connection of the respective electrical contact members of complementary parts 2 and 4.

FIG. 4 of the drawings shows an array of the present electrical connector assemblies, the details of which were previously disclosed when referring to FIGS. 1-3. In another preferred embodiment of the present invention, a plurality of the instant connector assemblies 1 are arranged to interconnect different runs of electrical wires, or the like, in an environment (e.g. a hot cell) that is hazardous to human life, wherein said interconnection is controlled by a workman who is stationed at a remote and environmentally safe work area (e.g. that known in the art as a gallery).

More particularly, the flange members of the respective housings 10 of each stationary, lower receiving connector part 4 may be secured (e.g. bolted) to a surface that is located within the environmentally hazardous area. By way of example, the surface to which each stationary receiving connector part 4 is attached may be a flat, platform end 30 of an electrical penetrator 32. In general terms, the electrical penetrator 32 extends through a protective wall or shielding (not shown) that separates the environmentally hazardous and safe areas from one another. Penetrator 32 provides conduit means by which to supply various cables 36 that carry runs of electrical wire, which wire may include, for example, power and instrumentation control lines from the remote work area for connection in the hazardous area at the respective terminal blocks 28 associated with each receiving connector part 4 (best shown in FIG. 1). For a more detailed explanation of an electrical penetrator 32, such as that described above, reference may be made to the co-pending U.S. patent application entitled PENETRATOR ASSEMBLY and assigned Ser. No. 120,066, filed 2/11/80 by the common assignee thereof.

Figure 5:
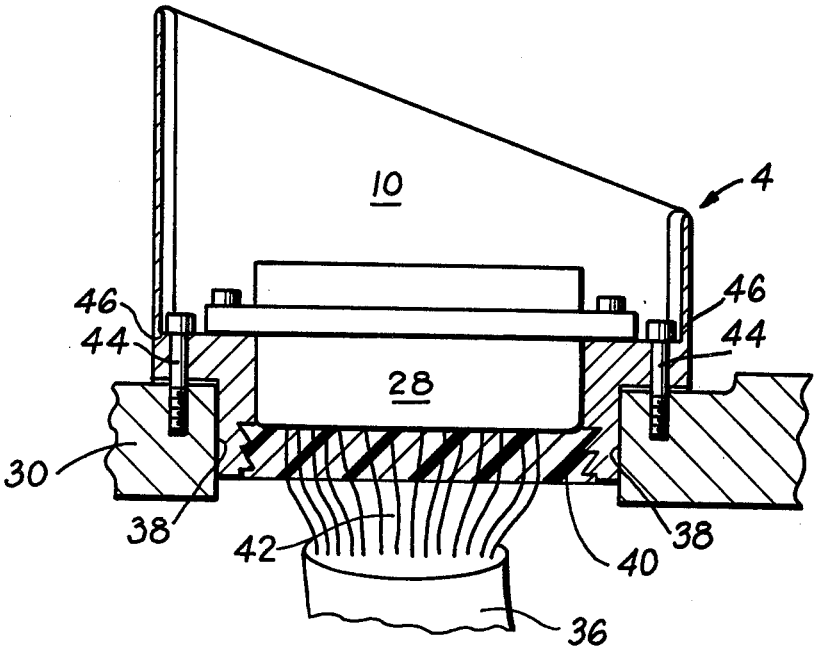
FIG. 5 is a partial cross section detailing one of the connector parts as taken along lines 5—5 of FIG. 1.

FIG. 5 of the drawings provides a detailed showing of a means for connecting a lower receiving connector part 4 to the platform end 30 of the electrical penetrator (described when referring to FIG. 4 of the drawings). The platform end 30 is provided with a plurality of recesses 38 that are each sized to receive therein a portion of the housings 10 of respective receiving connector parts 4. The electrical wires 42 that are carried by a cable 36 are attached to the associated contact members of a corresponding terminal block 28 through apertures in the recessed platform end 30. A potting compound, or similar material, is poured into the recess 38 to surround wires 42 and thereby provide a suitable pressure seal 40 between the terminal block 28 and the platform end 30.

Receiving connector part 4 may be secured to the platform end 30 by means of screws 44, or the like, which screws extend through apertures in a ledge 46 formed inside housing 10 near the bottom of connector part 4. In the assembled relationship, ledge 46 is seated upon and screwed to the platform end 30. Moreover, terminal block 28 may be secured within connector part 4 by screwing an extended edge thereof to the ledge 46. The application of ledge 46 to secure connector part 4 to platform end 30 is an alternative to the flanges associated with the bottom face 12 (of FIG. 1), whereby to minimize the consumption of space when a relatively large number of connector assemblies are to be positioned on the platform end 30.

In operation, and referring concurrently to FIGS. 1–5, inclusive, in order to effect a rewiring, repair, or replacement of the terminal block 26 or the corresponding wiring run associated with a respective engaging connector part 2, it will become necessary to detach the connector part 2 from its engagement within the housing 10 of complementary receiving connector part 4. An engaging connector part 2 can be disconnected from its receiving connector part 4 and removed to a location outside of the hazardous environment by means of either a conventional master-slave apparatus, electromechanical manipulator, or the like handling device, which device is remotely controlled atthe environmentally safe work area. The remotely controlled device typically includes a lift hook (not shown) whereby to engage the opening 22 formed in handling bar 20 at the top of a connector part 2 and, thereby, dislocate the upper connector part 2 from its complementary lower connector part 4.

Upon the completion of any alterations that are made to removable engaging connector part 2, a remotely stationed workman, who typically has limited visible access to the stationary receiving connector part 4, must effect the electrical reconnection of the complementary parts 2 and 4 by means of one of the aforementioned remotely controlled handling devices. In accordance with the present invention and by virtue of the configurations of connector parts 2 and 4 relative to one another, the top engaging connector part 2 can be accurately aligned with the bottom receiving connector part 4 in each of three orthogonal directions. As a result, the distant workman can thereby reliably and easily guide connector part 2 into electrical connection with connector part 4 by inserting connector part 2 through the open top of the housing 10 of connector part 4.

It will be apparent that while a preferred embodiment of the invention has been shown and described, various modifications and changes may be made without departing from the true spirit and scope of the invention. For example, while the presently disclosed electrical connector assembly has particular application in a hazardous environment, it is to be understood that said assembly may be utilized for connecting runs of wire in any generally inaccessible environment, wherein the detachable interconnection of the complementary connector parts is controlled by a workman at a distal location. What is more, while the respective housings of the connector parts are shown as being rectangular in shape, this is not to be considered a limitation of the present invention. Any other suitable housing configuration may be employed, so long as the structure of the connector assembly conforms to that disclosed, whereby the complementary connector parts can be accurately aligned with one another in each of three, generally orthogonal directions.

Having thus set forth a preferred embodiment of the present invention, what is claimed is:

1. An electrical connector assembly having at least two connector parts that can be detachably connected to one another at a remote location or hazardous environment by means of remote control, each of said connector parts having a respective housing and a contact member surrounded by said housing, the housing of a first of said connector parts comprising a front wall, a back wall, and side walls, said back wall projecting above said front wall and said side walls extending between said front and back walls, said last-mentioned housing also having an opening at one end thereof through which to receive the housing of the second of said connector parts, each of the front, back, and side walls of said first connector part housing being arranged with one another and adapted to be contacted by the housing of said second connector part in order that the housing of said second connector part will be accurately aligned in each of three orthogonal directions with the housing of said first connector part so as to thereby permit said second connector part to be reliably guided into connection with said first connector part via the projecting back wall and opened end of said first connector part housing in order to detachably mate the respective contact members of said two connectors parts.

2. The connector assembly recited in claim 1, further including a penetrator assembly for conveying through a partition at least one electrical cable means from an electrical source of supply to the contact member of the first of said connector parts, said penetrator assembly having a flat platform at one end thereof, which platform end being located at the remote or hazardous area and receiving thereon the housing of said first connector part, said platform end having an aperture formed therein for providing an exit path through which said electrical cable means can be connected to said first connector path contact member.

* * * * *